US005495812A

United States Patent [19]

Schulze

[11] Patent Number: 5,495,812

[45] Date of Patent: Mar. 5, 1996

[54] PLANT FOR INCINERATING EXPLOSIVE SUBSTANCES

[75] Inventor: Walter Schulze, Holzminden, Germany

[73] Assignee: bowas-induplan chemie ges.m.b.h., Salzburg, Austria

[21] Appl. No.: 140,181

[22] PCT Filed: May 5, 1992

[86] PCT No.: PCT/EP92/00973

§ 371 Date: Nov. 4, 1993

§ 102(e) Date: Nov. 4, 1993

[87] PCT Pub. No.: WO92/20969

PCT Pub. Date: Nov. 26, 1992

[30] Foreign Application Priority Data

May 10, 1991 [DE] Germany ..... 41 15 234.4

[51] Int. Cl.[6] ..... F23G 7/00; F23G 5/00; F23G 5/12

[52] U.S. Cl. ..... 110/237; 110/257; 110/334

[58] Field of Search ..... 110/235, 237, 110/257, 335, 173 B, 193, 334

[56] References Cited

U.S. PATENT DOCUMENTS 2,354,747 8/1944 Epstein et al. .

FOREIGN PATENT DOCUMENTS 0349865 7/1988 European Pat. Off. ..... 110/237
3822648 1/1990 Germany ..... F42D 5/04
1376763 12/1974 United Kingdom ..... B23P 3/09

*Primary Examiner*—Henry A. Bennett
*Assistant Examiner*—Susanne Tinker
*Attorney, Agent, or Firm*—Bell, Seltzer, Park & Gibson

[57] ABSTRACT

An installation is provided for the deflagration of explosives. The installation includes a splinter and explosive-proof tunnel housing having open ends and receiving a deflagration reactor positioned inside the tunnel housing and having an entry passageway and entry zone, a deflagration zone and an exit zone and exit passageway. A conveyor device extends from outside the reactor and into and through and out of the reactor and includes a plurality of carriers movable along the conveyor device for receiving and transporting explosives into and through the entry zone and into the reactor zone for ignition and burning of the explosives in the reactor zone. Each of the carriers includes a device for closing in substantially air-tight manner the entry passage and the exit passage as the carrier moves through the reactor. Devices cooperate with the device for closing the entry passageway and the exit passageway for allowing a controllable residual airflow through the reactor.

8 Claims, 4 Drawing Sheets

PLANT FOR INCINERATING EXPLOSIVE SUBSTANCES

FIELD OF THE INVENTION

The instant invention relates to an installation for the deflagration of explosives, comprising a deflagration reactor and a conveyor means extending inside and outside the reactor and including a plurality of carrier means which are loaded with the explosives outside of the reactor, then transported into the reactor to an ignition device for the explosives and on from the same with the deflagrating explosives inside the reactor, to finally leave the reactor again after completion of the burn-up.

BACKGROUND OF THE INVENTION

Such installations are known and serve the purpose of disposing of articles including matter which is liable to explode or explodable, e.g. ammunition, rockets, pyrotechnic sets, etc., especially from the military field. The reasons for disposal either are that the articles mentioned have reached a certain age from which on the defined characteristics assured upon manufacture of the substances which are liable to explode or explodable and required for their use can no longer be guaranteed or because, for example, weapons systems have been developed further and the ammunition already produced and on stock for those weapons systems can no longer be applied for their destined use.

The substances liable to explode or explodable mentioned above will be designated hereinafter by the term "explosives". That is generally understood to be solid, liquid, or gelatinous substances and mixtures of substances produced for purposes of detonating or propelling. However, in the instant case also substances which have not been made for the purpose of detonation or shooting also are combined under the term of explosives, such as organic peroxides as catalysts, gas release agents of present day foam and plastics engineering, some pesticides, and many others. Likewise included, for instance, is the well known mixture "thermite" which is understood as being mixtures of aluminum and iron oxide which react while developing a large amount of heat, forming aluminum oxide and iron. This development of heat is utilized for example for welding rails.

Explosives can be available as bulk material of any particle size, as adhesions, in the form of bodies having defined dimensions (e.g. pressed objects), or as a filler in hollow bodies. The list given by Rudolf Meyer in "Explosivstoffe", 6th edition, page 127 et seqq. may serve as an indication of the groups of substances to be understood by the term "explosives".

The disposal of explosives is realized worldwide by the so-called deflagration or detonation of these substances due to the lack of safety involved in their handling, both for the persons and the surrounding material. It is called "deflagration" because practically all explosives which are present in larger amounts continue to react upon initiation of the chemical decomposition reactions without the addition of another reactant, especially without the atmospheric oxygen which otherwise is customary in "combustion". While the aim of the burn-up of explosives is the relatively slowly progressing "deflagration" of the explosives at a combustion speed of less than 100 m per second, blow-up of explosives, as a general rule, will result in a "detonation" of the explosives which takes place at a relatively high combustion speed of from 1000 to 9000 m per seconds and is accompanied by a shock wave. Both terms "deflagration" and "detonation" will also be combined hereinafter under the term "explosion".

The known installations mentioned initially for the deflagration of explosives—predominantly—provide for deflagration in the traditional, known manner totally in the open or—as is the case, for example, with the installation described in DE-OS 38 22 648—in a security building which is given the character of an open combustion place due to its construction which includes a partially open blow-out wall. With the known installations of the first kind, the safety of persons is warranted by simple earthen protective dams which surround the place of deflagration or at least shields it in the direction of attending staff, or with an installation according to DE-0S 38 22 648 by a solid wall of a security building which wall, for example, separates the deflagration area from the feeding area.

The disadvantage of the known installations for the deflagration of explosives of the kind first mentioned resides especially in that in spite of guaranteeing the safety of persons, a reduction of emissions does not take place at all or only insufficiently due to the open or partly open (in the case of DE-OS 38 22 648) construction. During their decomposition reaction, explosives react to a large part into gaseous reaction products or also into solid substances which are contained in the resulting gaseous substances as combustion residues (ash) and/or as aerosols. With the known installations of the kind mentioned initially, these substances either are not collected at all or only insufficiently because the prerequisite for such collection of the harmful substances being released, namely a closed space with a corresponding collector seems impossible, according to the expert knowledge available so far, due to the risks involved in such a closed space in the event of an (unintended) detonation of the explosives.

OBJECT AND SUMMARY OF THE INVENTION

It is the object of the instant invention to devise an installation for the deflagration of explosives of the kind mentioned initially such that a substantially complete emission protection with simultaneous maintenance of full safety to persons is warranted. This object is based on the guidelines and regulations, respectively, laid down in the fourth federal emission protection order (4th BImSchV), the explosives destruction guidelines by the social insurance against occupational diseases of the chemical industry and the accident prevention order "46*a* Explosivstoffe und Gegenstände mit Explosivstoff—Allgemeine Vorschrift— (VBG 55*a*)".

This object is met, in accordance with the invention, in an installation for the deflagration of explosives of the kind mentioned initially, in that the deflagration reactor is arranged inside a tunnel which is substantially splinter- and explosion-proof.

The advantages of the invention above all reside in the fact that the deflagration reactor and the splinter- and explosion-proof tunnel form a closed deflagration installation in which the gaseous components of the reaction products formed during the combustion are collected and released into the surrounding atmosphere upon reduction of the noxious components, and the liquid and/or solid reaction products are processed to environmentally safe products suitable for dumps, while personal safety in accordance with legal regulations is constantly guaranteed at the time the deflagration is carried out. In this respect it is especially advantageous that the conditions of the 17th BImschV or the emission limit values of the technical specification on air (TA Luft) can be complied with together with the simultaneous personal safety according to the legal regulations and those of the social insurance against occupational diseases.

Preferred further developments of the invention are indicated in the subclaims.

Thus, for instance, the tunnel preferably is made of a tube and a sand cover on the tube, a further development which in the first place relates to the safety of persons in the event of an (unintended) detonation of the explosive during deflagration. In the event of such a detonation the deflagration reactor is fractured into splinters—starting from the seat of the detonation—and these penetrate the tube at very high speed in front of the detonation shock wave and—depending on the intensity of the detonation—also disintegrate the tube.

The sand cover around the tube has a twofold task to fulfill in this context: on the one hand, the sand cover serves to intercept the splinters of the deflagration reactor and possibly also those of the tunnel tube. On the other hand, the sand cover will collapse and cover the seat of the deflagration in case the tunnel tube, too, disintegrates. The sand cover which extends around and over the tunnel tube thus provides a protective jacket which, on the one hand, is extremely flexible because it is not rigidly damping and, on the other hand, is extremely safe and effective while, at the same time, extinguishing fire which occurs upon detonation.

A further development according to which the tube preferably is composed of oval steel pipe sections serves to provide a structure of the tunnel tube which is as easy as possible to realize. The advantages of this oval shape above all reside in that these sections, in general, are commercially available and that inspection alleys to be walked into form along both longitudinal sides of the deflagration reactor.

Two other preferred embodiments relate to the design of the deflagration reactor. According to one of them it is provided that the same has a substantially rectangular shape which is elongated in the direction of transportation of the conveyor means, and according to the other preferred further development it is provided that the body of the deflagration reactor is made of metal sections. Especially with the structure of metal sections it is advantageous that these disintegrate into light splinters in relatively defined manner in case of a detonation of the explosives, thus requiring less sand cover for slowing down than would be required with a heavy structure of the deflagration reactor. In principle, however, the body of the deflagration reactor can consist of sections of other materials, e.g. plastics. It is another advantage of the structure made of metal sections that the deflagration reactor thus can be prefabricated inexpensively outside of the tunnel tube and assembled inside the tunnel tube.

Preferably the inner walls of the body of the deflagration reactor are lined with temperature-proof fibrous material. The fibrous material, in the first place, serves to accommodate the very great temperature difference which occurs during the deflagration of explosives in the deflagration reactor. The temperature in the deflagration reactor rises within seconds to from 2000° to 3000° C.—starting from the seat of the deflagration —in the vicinity thereof and in particular above the seat of the deflagration because the chemical decomposition reaction of explosives is a strongly exothermic process. The temperature-proof fibrous material is arranged in order to intercept the resulting thermal radiation and especially to keep it off the metal sections of the deflagration reactor. Rock wool is preferred for use here.

Preferably the deflagration reactor comprises an air suction means including at least one supply pipe end connection disposed in the entry zone of the deflagration reactor and at least one suck-off pipe end connection disposed in the exit zone.

According to another advantageous further development the entry zone is separated from the deflagration zone by a shutter adapted to be locked. The louvers of the shutter are adjustable, especially individually, i.e. independently of one another. The shutter offers several essential advantages in connection with the air flow passing through the deflagration reactor: On the one hand, the shutter permits an advantageous flow direction through the deflagration reactor to be adjusted which flow direction should be designed such that although the fresh air supplied, on the one hand, mixes as quickly as possible with the resulting hot exhaust gases, thereby causing cooling of the exhaust gases and oxidation of those reaction products not yet completely burnt, on the other hand, however, whirling up of the explosives located in the carrier means is avoided. Due to the adjustability of the louvers independently of one another, the plane of the principal air current through the deflagration reactor can be varied from an upper via a central to a lower area. Finally, a certain low pressure can be adjusted in the deflagration reactor with the aid of the shutter at a certain volume flow. This low pressure makes sure that the gaseous reaction products will leave the deflagration reactor only through the air suction means. This brings about the economically important advantage that the deflagration reactor, in general, may be leaky, a fact permitting manufacture at more favorable cost.

It is especially preferred if the entry zone and exit zone comprise a passage each for the carrier means entering and leaving the deflagration reactor by the conveyor means. According to a first further development these passages are of such design that they are locked in substantially air-tight manner by the carrier means which are moving through in transportation direction. These two further developments thus have a beneficial influence on the generation of a continuous and controllable air stream from the entry zone through the deflagration zone to the exit zone of the deflagration reactor.

Moreover, it is preferably provided that there is a spark flap arranged at the end of the inlet passage in the area of transition from the entry zone to the deflagration zone. Preferably this is designed with recoil cushioning, and it prevents spark transport from the explosives in the process of burning in the deflagration zone to the explosives still on the carrier means in the area of the inlet passage.

A particularly preferred embodiment of the conveyor means and of the associated plurality of carrier means consists in the carrier means being designed as movable carriages which comprise a vat to receive the explosives to be burnt up. The carrier means thus can be designed in the manner of dumpcarts which then seal the inlet and outlet passages, respectively, during their passage in substantially air-tight fashion, i.e with the exception of a defined residual air flow—according to a preferred further development of the invention already explained above. This residual air flow passes through the carriage region of the carrier means into the deflagration reactor and, on the one hand, effects cooling of the vats which contain the explosives and, on the other hand, causes cleaning of the pathway on which the carrier means roll through the deflagration reactor.

The sand cover which lies on the tunnel tube preferably is supported laterally by solid walls, one of these solid walls being separated parallel to the tunnel a feed zone for feeding the carrier means with explosives. The conveyor means thus can comprise a revolving rail for the movable carriages extending through the feed zone, leading to the deflagration reactor, and subsequently again connecting the end of the outlet passage with the feed zone.

To enhance the emission protection, it is preferably provided that a scrubbing means for the gaseous reaction products formed during deflagration is connected downstream of the deflagration reactor or the suck-off connection of the air suction means. It is especially preferred if the scrubbing means contains washing stages which separate the noxious components produced in all states of aggregation from the exhaust gas.

The scrubbing means further may comprise thermal reducing stages for noxious components or—alternatively or additionally—biological reducing stages for noxious components to deal with those harmful substances which were only incompletely or not at all removed by the washing stages.

A preferred embodiment of the invention will be described in greater detail below with reference to a drawing, in which.

Figure 1:
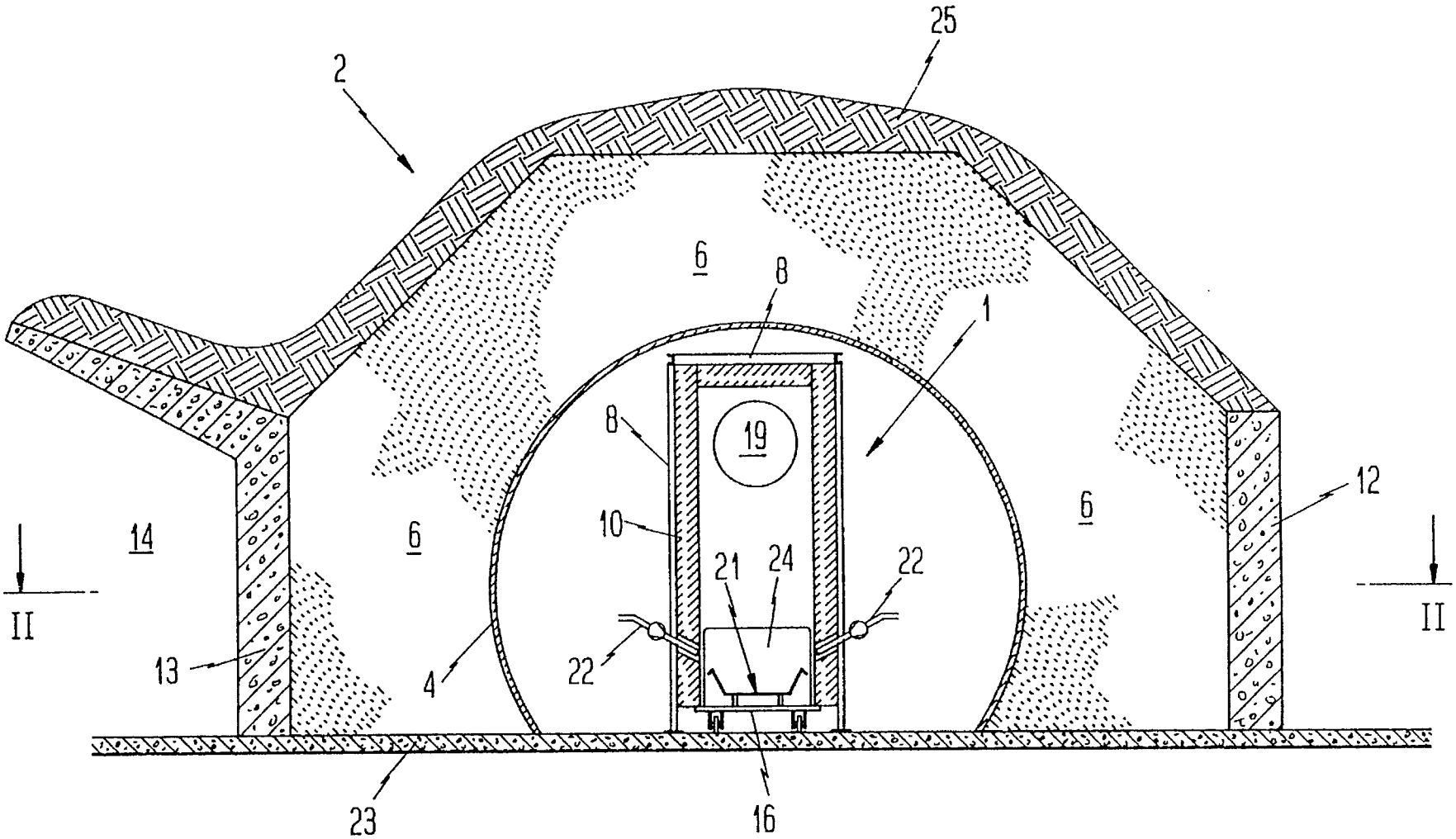
FIG. 1 is a cross sectional view of the substantially splinter- and explosion-proof tunnel with the deflagration reactor disposed inside the same.

FIG. 1 illustrates a deflagration reactor 1 of an installation for the deflagration of explosives arranged in a substantially splinter- and explosion-proof tunnel 2. This tunnel 2 consists of a tube 4 composed of oval steel pipe sections and of a sand cover 6 which covers the tube 4 and which itself is supported laterally by solid walls 12, 13 and an upper cover 25. The deflagration reactor 1 stands on a concrete floor 23 inside the tunnel tube 4 and has an approximate height of 3 m, while the tunnel tube 4 has a clear height above the concrete floor of approximately 4 m. A feed zone 14 for feeding carrier means 16 with explosives to be burnt up is disposed parallel to the tunnel 2 and separated from the tunnel 2 by a solid wall 13. The tunnel tube 4, the sand cover 6, and the solid wall 13 warrant the personal safety required during operation of an installation for the deflagration of explosives. The respective processes taking place in the event of an (unintended) detonation of the explosives which actually should be deflagrated will be explained below.

Figure 2:
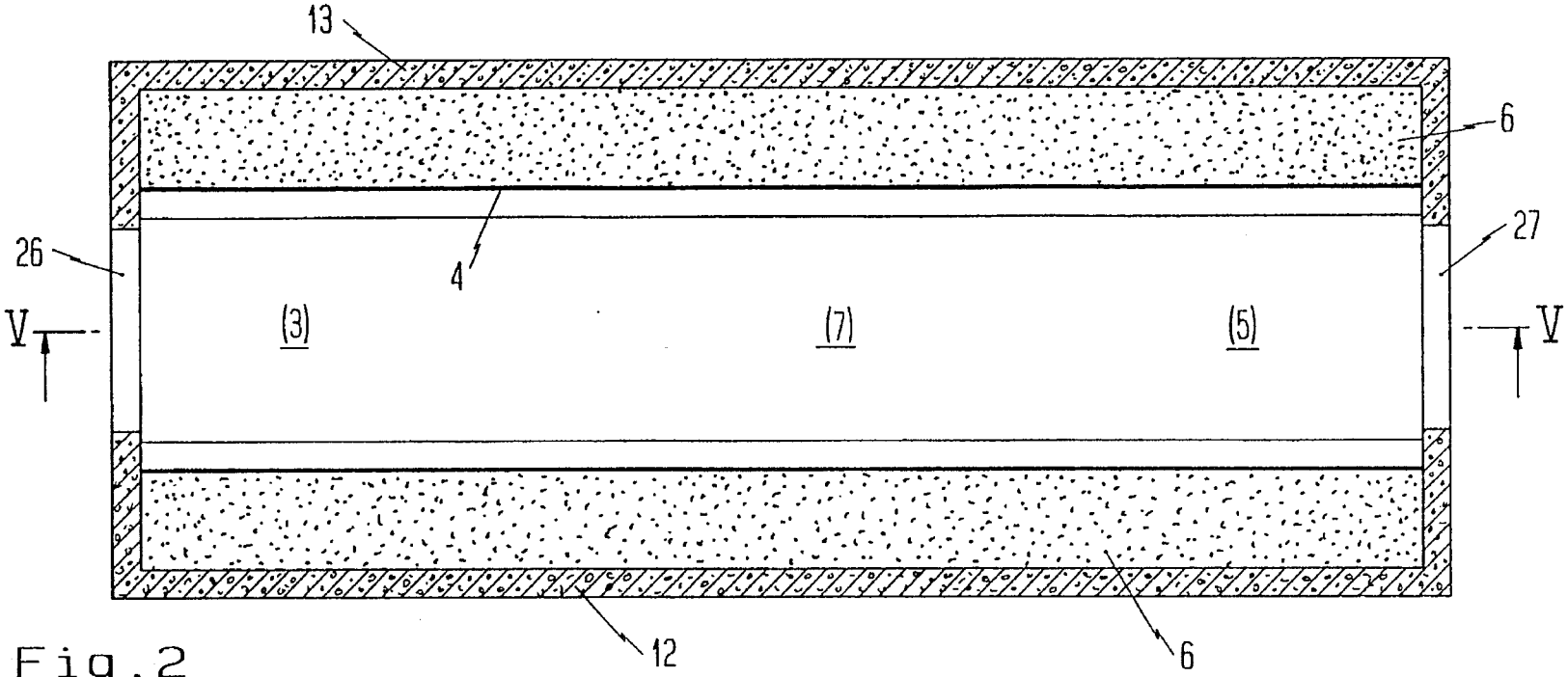
FIG. 2 shows a diagrammatic floor plan of the tunnel with sand cover.
Figure 4:
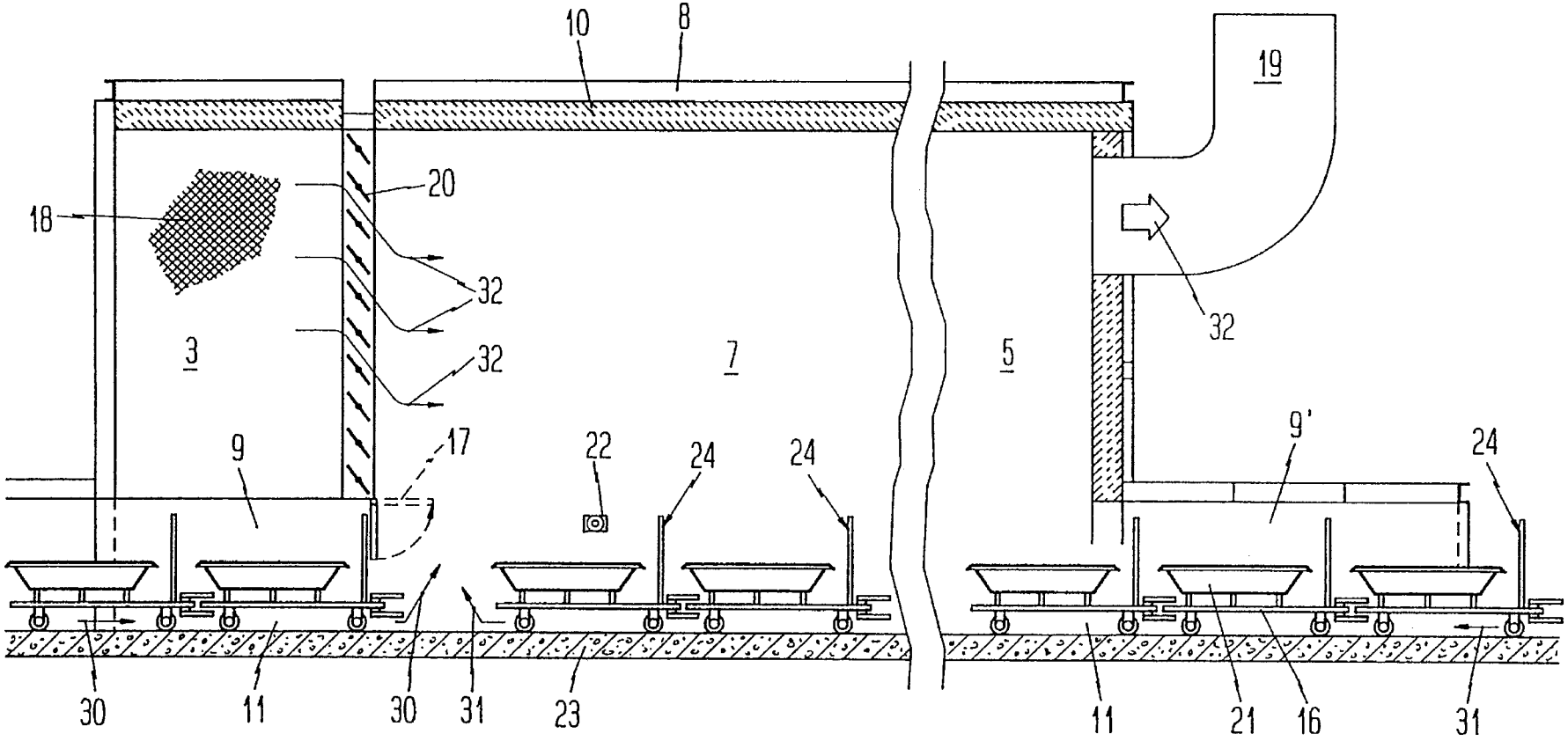
FIG. 4 is a cross section of the deflagration reactor with carrier means passing through in the direction of transportation.

The feed zone 14 is connected by a conveyor means 11 (shown only in part in this figure) to the tunnel 2 or the deflagration reactor 1 arranged inside the same and forms an especially ovally extending, endless transport line on which the carrier means 16 belonging to the conveyor means 11, after having passed the feed zone 14, first pass through the entry zone 3 of the deflagration reactor 1, then the deflagration zone 7, and subsequently the exit zone 5 of the deflagration reactor 1, and subsequently are advanced again to the feed zone 14 (FIGS. 2, 4). The reactor 1 has a substantially rectangular shape which is elongated in transportation direction of the conveyor means 11 (FIG. 4), and the body of the reactor 1 is built of metal sections 8. The inner walls of the body of the deflagration reactor 1 are lined with rock wool 10 for protection of the metal sections 8 against the very high temperatures occurring upon deflagration of explosives (up to 3000° C.). In the course of the transportation direction the deflagration reactor 1 further comprises an entry 26, the entry zone 3 already mentioned, the deflagration zone 7, and the exit zone 5 as well as an exit 27 (FIG. 4). Inside the tunnel tube 4 the deflagration reactor 1 rests on the concrete floor 23.

Figure 5:
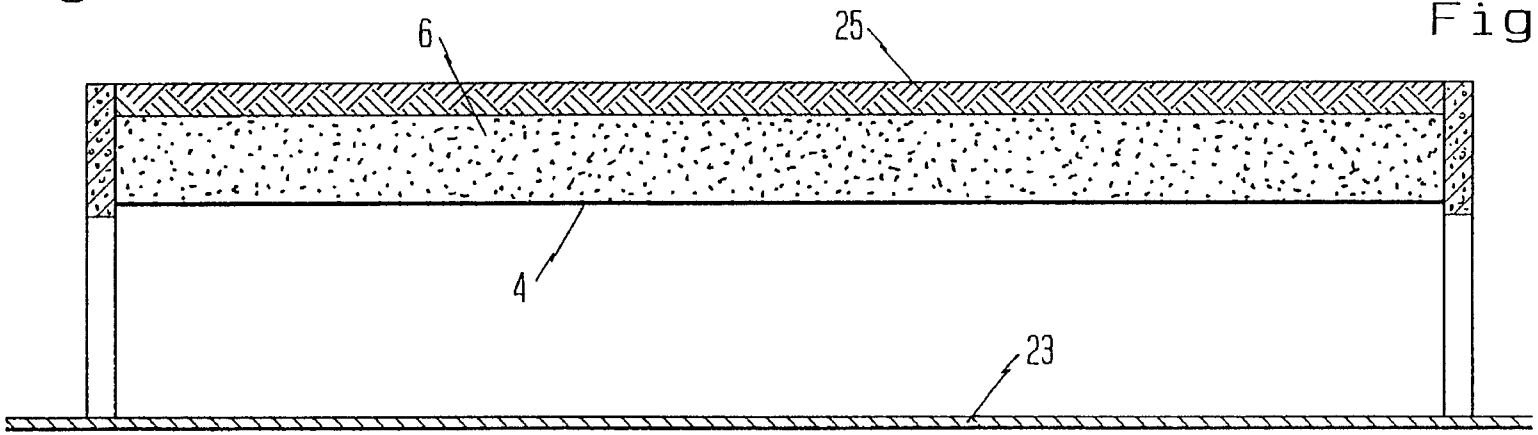
FIG. 5 is a diagrammatic side elevation of the tunnel according to FIG. 2.

FIGS. 2 and 5 show a floor plan and a side elevation of the tunnel 2 with the sand cover 6, the deflagration reactor 1 not being shown here. The substantially rectangular and elongated shape of the tunnel 2 is to be gathered on the whole from the illustration. The entry zone 3, the deflagration zone 7, and the exit zone 5 of the deflagration reactor 1 not included in the drawing are indicated by the reference numerals in parentheses.

Figure 3:
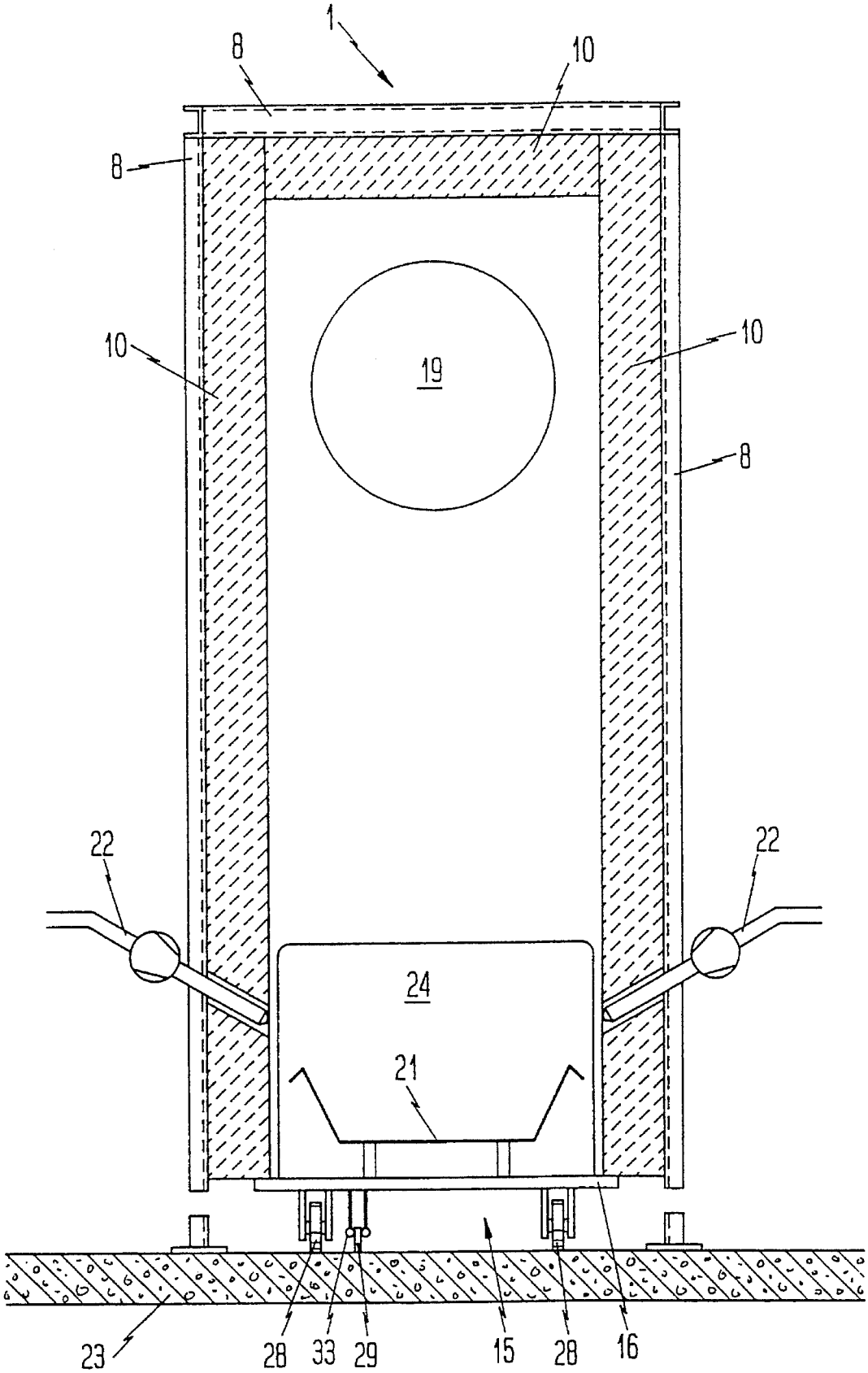
FIG. 3 is a cross section through the deflagration reactor at the level of the ignition device.

FIG. 3 shows an enlarged cross section as compared to FIG. 1 of the deflagration reactor 1 at the level of the ignition device. Inside the deflagration reactor 1 one carrier means in the form of a movable carriage 16 is presented which comprises an undercarriage 15 movable on wheels 28 and a vat 21 arranged on top of the same to take up the explosives to be deflagrated. Behind the vat 21 a partition 24 can be seen which here, when looking in the direction of transportation of the carriage 16, is disposed vertically behind the vat 21 on the undercarriage 15 of the carriage. To the right and left of the carriage 16 there are arranged a burner 22 each of the ignition device by means of which the explosives are ignited. On their way through the deflagration reactor 1 the carrier means or carriages 16 are guided by a routing device 29 belonging to the conveyor means 11 and by corresponding guide rails 33, or they can also be driven by way of these structural components. Above the carriage 16, a suck-off connection 19 of an air suction means can be seen which is arranged in the exit zone 5 of the deflagration reactor 1. The function thereof will be explained in greater detail with reference to FIG. 4.

FIG. 4 shows a longitudinal sectional elevation of the deflagration reactor 1 through which pass a plurality of carrier means or carriages 16 described above which convey the explosives to be burnt from the feed zone 14 into the deflagration reactor 1 and remove the residues produced during combustion for further disposal. The carriages 16 loaded with explosives travel through the inlet passage 9 of the entry zone 3 into the deflagration reactor 1 and are advanced successively to the deflagration zone 7. There the ignition device is arranged with the burners 22 provided at both sides where the ignition of the explosive takes place in the vat 21 of the respective carriage 16. To prevent spark-over to the succeeding carriages 16 still loaded with explosives, a spark flap 17 is arranged in the area of transition from the entry zone 3 to the deflagration zone 7 at the end of the inlet passage 9, and it is embodied with recoil cushioning to avoid further spark formation. This spark flap 17 cooperates with the partition 24 of the next successive carriage 16 to close the inlet passage 9 in almost complete air-tight manner. Merely a small residual amount of fresh air is guided in the direction of the arrows 30 below the carriages 16 through the inlet passage 9 into the deflagration zone 7 and serves, on the one hand, for cooling the carrier means from below and further forms an upwardly directed air current in the deflagration reactor, preventing explosives or their reaction products from falling on the pathway. In particular further air flaps can be provided in the side walls of the deflagration reactor 1 to permit regulation of the temperature of the air flow.

The carriages 16 with the burning explosives are moved on slowly in the direction of transportation from the position of the burner 22 so that the burn-up of the explosives takes place entirely within the deflagration reactor 1. The duration of such burn-up on average is in the range of seconds to minutes. Upon termination of the combustion, the carriages 16 leave the deflagration reactor 1 through the outlet passage 9' which belongs to the exit zone and which—like the inlet passage 9—is locked in substantially air-tight manner by the construction of the carriages 16 (especially partition 24). In a manner similar to the inlet passage 9, merely a small but intentional share of fresh air gets through the outlet passage 9' in the direction of the arrows 31 into the deflagration zone 7.

The air suction means already mentioned above of the deflagration reactor 1 includes supply connections 18 (of which the suction grid of the one supply connection is shown here) disposed at both sides in the entry zone 3 of the reactor 1 and a suck-off connection 19 arranged centrally in the exit zone 5 of the reactor 1. This suck-off connection 19 is followed—not shown here—by a scrubbing means for the reaction products formed during the deflagration. This scrubbing means, on the one hand, includes washing stages for separating the harmful substances which occur in all states of aggregation from the exhaust gas and—as an alternative or in addition—thermal or biological reducing stages for noxious components.

The air sucked in through the supply connections 18 and sucked out through the suck-off connection 19 in the direction of the arrows 32 essentially has three functions. On the one hand, it warrants the quantitative conveyance of the gaseous reaction products and the aerosols contained in them into the washing stage for flue gas scrubbing. On the other hand, however, the air is needed to limit the input temperature in the washing stage, which preferably includes a venturi scrubber, to a maximum value of approximately 300° C. This is of particular importance especially in consideration of the background already described initially in connection with the lining of the deflagration reactor 1 that the explosives burn up at temperatures of up to 3000° C. The third function of the air sucked in or off within the reactor 1 is to be seen in that it is to establish oxidizing conditions inside the deflagration reactor 1 in order that the proportion of non-oxidized substances formed during deflagration is kept as low as possible. Therefore, this air serves to supplement the deflagration by residual combustion of the substances which are not sufficiently or not at all oxidized and, consequently, to increase the reduction of emissions.

The air flow directed from the supply connection 18 to the suck-off connection 19 (arrows 32) is adjustable to a defined value in terms of flow direction and amount of air by the adjustable shutter 20 which is lockable as regards its louver positions.

Apart from the venturi scrubber mentioned, the washing stages of the scrubbing means also may comprise one or more wet purifiers. While it is the task of the venturi scrubber to cool the hot exhaust gases having a temperature of about 300° C. down to a cooling limit temperature and to strip the major part of the aerosols, such as soot, metal compounds, phosphorous pentoxide, etc. (other harmful substances, too, are separated in the venturi scrubber depending on the exhaust gas composition, like HCL, HF and also noxious components of alkaline effect due to the low pH then obtained, such as ammonia).

Of the wet purifiers, one may be provided for the acidic shares of the exhaust gases (especially HCL, HF, and $NH_3$) as well as one for the basic shares of the exhaust gases. While the acid purifier is designed as a spray washer according to the countercurrent principle, the basic purifier operates according to the unidirectional flow principle at a pH of about 9. In the basic scrubber, weaker acids are absorbed, such as $SO_2$, $H_2S$, and HCN.

The protective function of the deflagration installation for maintaining personal safety in the event of an (unintended) detonation of the explosive will be explained below with reference to FIG. 1. Upon detonation, the deflagration reactor 1 is dismantled into splinters which fly at very high velocity through the steel tunnel tube 4, possibly dismantling that as well. The splinters of the deflagration reactor 1 and of the steel tunnel tube 4 are intercepted by the sand cover 6, which sand cover 6 comes to lie over the seat of the detonation if the steel tunnel tube 4 is disintegrated and, with the sand, extinguishes a fire which is to be expected.

The installation described above for the deflagration of explosives, processing a quantity of from 1000 to 1500 kg per hour, affords a considerable contribution to the environmentally adequate immission reduction with simultaneous full maintenance of personal safety. In the installation described, particularly the harmful substances to be expected, hydrochloric acid, phosphorus, sulfur oxides, hydrocyanic acid, and nitrogen oxides are bound and disposed of. However, the design of the installation in principle allows the disposal of any harmful substances which occur and for which purifying plants and methods are and will be economically and technically realizable now or in the future. The deflagration installation presented permits the downstream connection of all those purifying apparatus without altering the nucleus of the deflagration installation, namely the deflagration reactor 1 arranged within the substantially splinter- and explosion-proof tunnel 2.

I claim:

1. An installation for the deflagration of explosives comprising:

a splinter and explosive-proof tunnel housing having open ends;

a deflagration reactor positioned inside said tunnel housing and having an entry passage and entry zone, a deflagration zone and an exit zone and exit passage;

conveyor means extending from outside said reactor and into and through and out of said reactor and including a plurality of carrier means movable along said conveyor means for receiving and transporting explosives into and through said entry zone and into said reactor zone for ignition and burning of the explosives in said reactor zone, each of said carrier means including means for closing in substantially airtight manner said entry passage and exit passage as said carrier means move through said reactor; and means cooperating with said means for closing said entry passageway and said exit passageway for allowing a controllable residual airflow through said reactor.

2. An installation for the deflagration of explosives, as set forth in claim 1, in which said tunnel housing includes oval steel pipe sections forming the inside thereof.

3. An installation for the deflagration of explosives, as set forth in claim 2, in which said tunnel housing further includes solid outer walls spaced from said inside oval pipe sections and sand filling the space between said solid outer walls and said inner oval pipe sections.

4. An installation for the deflagration of explosives, as set forth in claim 1, in which said deflagration reactor comprises a housing having metal sections.

5. An installation for the deflagration of explosives, as set forth in claim 4, in which said reactor further includes temperature-proof fibrous material lining inner walls of said housing.

6. An installation for the deflagration of explosives, as set forth in claim 1, in which said means for allowing a controllable residual airflow includes air supply means positioned in said entry zone and an air suction means positioned in said exit zone.

7. An installation for the deflagration of explosives, as set forth in claim 6, in which said means for allowing a controllable residual airflow further includes lockable shutter means separating said entry zone and deflagration zone and including individually adjustable louvers.

8. An installation for the deflagration of explosives, as set forth in claim 1, further including spark flap means positioned between said entry zone and said deflagration zone.

* * * * *

UNITED STATES PATENT AND TRADEMARK OFFICE

CERTIFICATE OF CORRECTION

PATENT NO. : 5,495,812

DATED : March 5, 1996

INVENTOR(S) : Walter Schulze

It is certified that error appears in the above-identified patent and that said Letters Patent is hereby corrected as shown below:

On title page, item [54] and col. 1, line 1,

In the title, "PLANT" should be -- INSTALLATION --.

References Cited, U.S. Patents, add -- 3,793,101 2/1974 Mullarkey --.

Foreign Patent Documents, add -- 1 131 132 6/1992 Germany --.

Column 2, line 14, "DE-0S" should be -- DE-OS --.

Column 5, after line 21, insert the following heading -- BRIEF DESCRIPTION OF THE DRAWINGS --.

Column 5, after line 36, insert the following heading -- DESCRIPTION OF PREFERRED EMBODIMENTS OF THE INVENTION --.

Column 8, line 21, "immission" should be -- emission --.

Signed and Sealed this

Fifth Day of November, 1996

*Attest:*

Bruce Lehman

BRUCE LEHMAN

*Attesting Officer*

*Commissioner of Patents and Trademarks*